313-422 SR
1/31/84 XR 4,429,251

United States Patent [19]

Gange

[11] 4,429,251

[45] Jan. 31, 1984

[54] LINE CATHODE SUPPORT STRUCTURE FOR A FLAT PANEL DISPLAY DEVICE

[75] Inventor: Robert A. Gange, Belle Mead, N.J.

[73] Assignee: RCA Corporation, Princeton, N.J.

[21] Appl. No.: 355,253

[22] Filed: Mar. 5, 1982

[51] Int. Cl.[3] ..... H01J 29/50; H01J 29/70

[52] U.S. Cl. ..... 313/411; 313/417; 313/422

[58] Field of Search ..... 313/422, 411, 417, 456, 313/409, 446, 451, 302, 337, 270, 341

[56] References Cited

U.S. PATENT DOCUMENTS 4,121,130 10/1978 Gange ..... 313/409 X 4,217,519 8/1980 Catanese et al. ..... 313/411

*Primary Examiner*—Palmer C. Demeo
*Assistant Examiner*—Sandra L. O'Shea
*Attorney, Agent, or Firm*—Eugene M. Whitacre; Dennis H. Irlbeck; Lester L. Hallacher

[57] ABSTRACT

A support for supporting the line cathode of a flat panel display device is electrically insulative and has low thermal conductivity. The support is U-shaped and has a notch in the closed end for supporting the cathode a precise distance from the entrance to the guide mesh assembly. The support is spring loaded in the guide mesh assembly and is retained by retainer means on the support and in the guide mesh assembly.

8 Claims, 3 Drawing Figures

LINE CATHODE SUPPORT STRUCTURE FOR A FLAT PANEL DISPLAY DEVICE

BACKGROUND OF THE INVENTION

This invention relates generally to flat panel display devices and particularly to a line cathode support structure for such devices.

U.S. Pat. No. 4,217,519 discloses a modulator structure for a flat panel display device. An insulative modulator support has a plurality of modulation electrodes disposed on one side. The support structure is affixed to an insulative baseplate which also supports a plurality of modulation electrodes. The modulation electrodes are electrically connected in pairs whereby one electrode for each pair is supported by the modulator support and the other by the baseplate. A line cathode is arranged across the entire transverse, or horizontal, dimension of the display device between the modulation electrode pairs. The display device is divided into channels and each includes a beam guide assembly having two spaced guide meshes between which electrons propagate as beams. The entrance to each of the beam guide assemblies is arranged between the modulation electrode pairs so that electrons from the cathode are injected into the spaces between the guide meshes.

U.S. patent application Ser. No. 125,822, filed Feb. 29, 1980 by M. A. Leedom now U.S. Pat. No. 4,330,735 and entitled "Beam Guide Structure For A Flat Panel Display Device" discloses a beam guide assembly which can be utilized along the modulator structure disclosed in the above referenced patent. The beam guide assembly includes two parallel spaced guide meshes between which electrons from a line cathode propagate as beams. Spaced from and parallel to the guide meshes is a focus mesh which cooperates with a plurality of extraction electrodes on the display device baseplate to focus the electron beams between the guide meshes. Arranged parallel to and spaced from the focus mesh is an acceleration mesh which accelerates the extracted electron beams toward the phosphor screen of the display device. The meshes of the beam guide assembly are held in the desired parallel relationship and spacing by a plurality of insulative support members which extend perpendicular to the surfaces of the meshes. One end of each support member extends a precise distance beneath the lower guide mesh to support the guide mesh assembly the precise distance above the extraction electrodes.

The devices disclosed in the referenced patent and patent application are multichannel devices which utilize a single line cathode to provide electrons to the guide mesh assemblies within every channel. It therefore is critical that the line cathode be aligned with the entrance to the guide mesh assemblies and that the position of the cathode with respect to such entrances be identical and permanent within very close tolerances. The instant invention solves these difficulties by the provision of a cathode support structure which precisely locates and supports a line cathode at the entrance to the beam guide assemblies of a flat panel display device.

SUMMARY OF THE INVENTION

A flat panel display device is divided into a plurality of channels. Each channel includes a plurality of guide meshes to form a space in which electrons from a line cathode propagate as beams. A cathode support structure for supporting the cathode equidistant from and in alignment with the spaces for every channel includes a substantially U-shaped support transversely dimensioned to span the space. The U-shaped support is spring biased against the meshes. The U-shaped support material has high thermal impedance and is electrically insulated. A notch which is arranged in the closed end supports the cathode in alignment with the space and the support is longitudinally dimensioned to support the cathode a predetermined distance from the space between the guide meshes.

DETAILED DESCRIPTION OF THE PREFERRED EMBODIMENT

Figure 1:
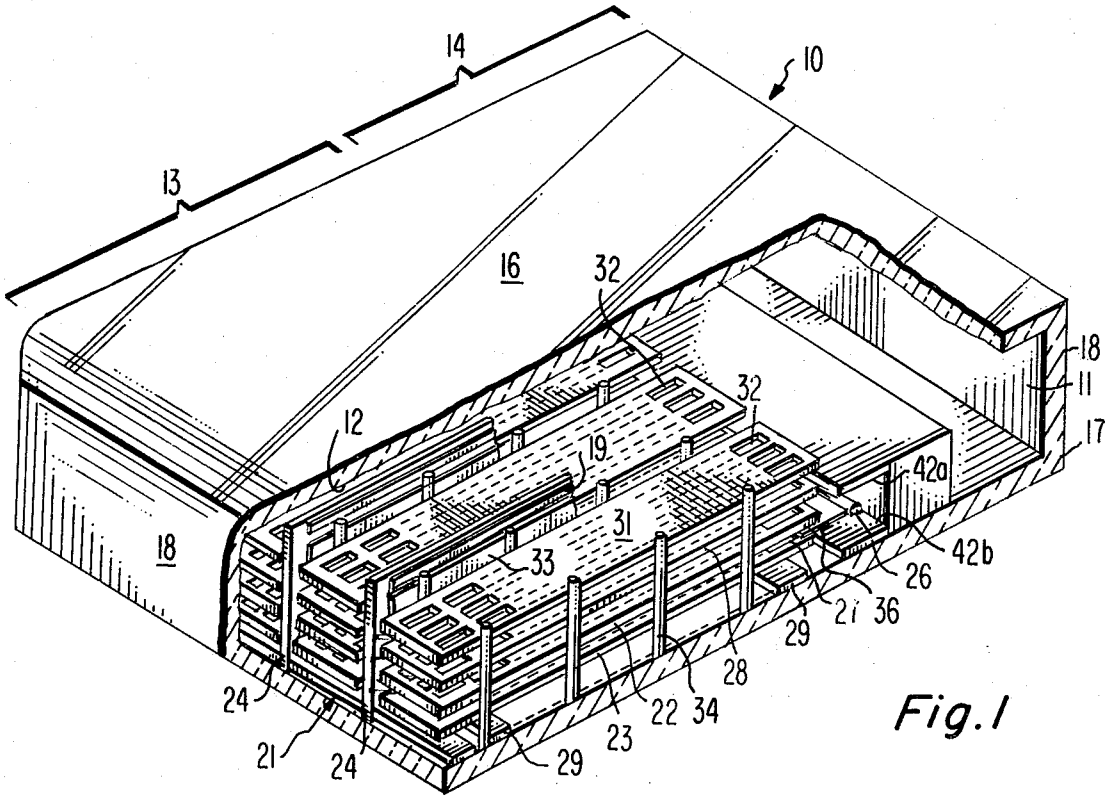
FIG. 1 is a perspective view, partially broken away, of a flat panel display device incorporating the preferred embodiment.

FIG. 1 shows a flat panel display device 10 incorporating the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs. The guide meshes 22 and 23 include apertures 27 which are arranged in columns longitudinally along the channels 21 and in rows transversely across the channels. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to be periodically focused between the guide meshes 22 and 23 and to propagate in the spaces 24 for the full length of the channels.

An acceleration mesh 31 is arranged in a spaced parallel relation with the focus mesh 28 and contains a plurality of apertures 32 which also are aligned in columns longitudinally of the channels and in rows transversely of the channels. Scanning electrodes 33 are arranged on both sides of the support vanes 29 so that each vane supports a scanning electrode for two adjacent channels. Insulative beads 34 engage the meshes 22, 23, 28 and 31 to retain the meshes in the desired spaced relationship.

In operation, the electron beams propagate in the spaces 24 between the guide meshes 22 and 23 until the production of one horizontal line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 32 in the acceleration mesh 31 and the focus mesh 28. The extracted electron beams are horizontally scanned across the channels 21 by the application of varying voltages, such as sawtooth waveforms, to the scanning electrodes 33 on the sides of the support vanes 19. Every channel therefore is horizontally scanned between the two support vanes 19 so that each channel contributes a portion of each horizontal line of the visual display on the faceplate 16. The same line cathode supplies the electrons for every channel and each channel contributes to every horizontal line of the display. For these reasons, it is critical that the cathode be supported the same distance from the entrances to the spaces 24 in the beam guide assemblies and that the cathode is aligned with such entrances.

Figure 2:
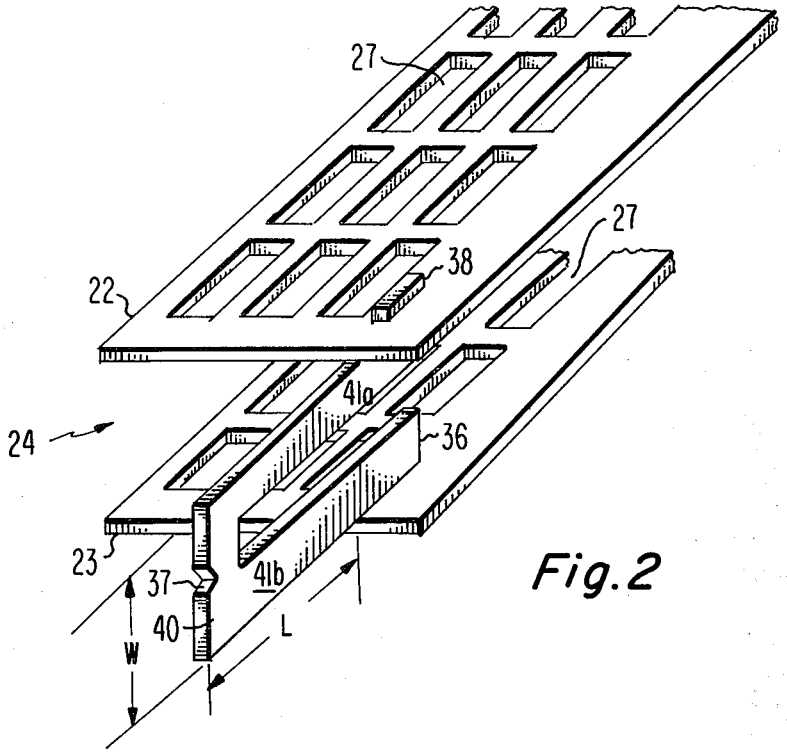
FIG. 2 is a perspective view, partially broken away, of a preferred embodiment.

In FIG. 2, a U-shaped support 36 is arranged in the space 14 between the guide meshes 22 and 23. The transverse dimension W of the U-shaped support 36 is determined by the transverse dimension of the space 24 between the meshes 22 and 23. Typically, in a flat panel display device, this dimension is in the order of 50 to 60 mils. Transversely, the support 36 is perpendicular to the surfaces of the meshes 22 and 23 and longitudinally is parallel to the meshes. Arranged in the closed end 40 of the U-shaped support 36 is an indication, or notch, 37 which is dimensioned to receive the line cathode 26. The position of the notch 37 is such that the cathode is located at the desired position with respect to the entrance to the space 24 between the meshes 22 and 23. Accordingly, typically the notch 37 is located to center the cathode between the meshes 22 and 23.

Figure 3:
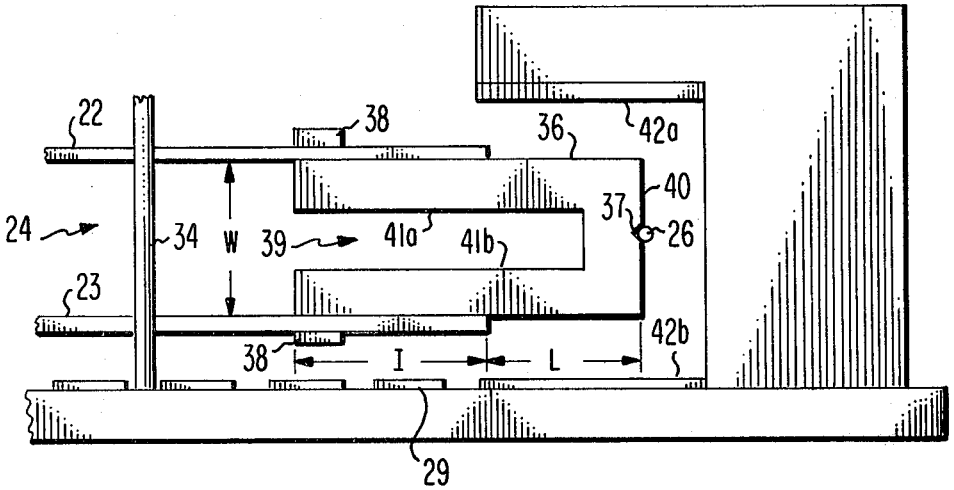
FIG. 3 is a side view showing the relationship of the preferred embodiment and the modulation electrodes of a flat panel display device.

As shown in FIG. 3, the U-shaped support 36 includes two tabs 38 located in the proximity of the open end of the support. The tabs 38 pass through apertures in the meshes 22 and 23 so that the U-shaped support 36 is accurately positioned with respect to the input ends of the meshes 22 and 23. The U-shaped support 36 also includes a longitudinal slot 39 between two longitudinal arms 41*a* and 41*b*.

The U-shaped support 36 is fabricated from an electrically insulative material which has low thermal conductivity and sufficient resilience to permit the arms 41*a* and 41*b* to be biased toward one another to permit the insertion of the tabs 38 into the apertures in the meshes 22 and 23. The resilience of the support also spring biases the support against the meshes to hold the support in place. A material which can be used to fabricate the U-shaped supports is Quartz. The support 36 can be fabricated from a nonresilient material, such as ceramic, when the material from which the meshes 22 and 23 are made has sufficient resilience to spring load the meshes against the support.

As shown in FIGS. 1 and 3, the guide meshes 22 and 23 are held in a spaced parallel relationship by insulative posts 34. The lower guide mesh 23 is supported a precise distance above the extraction electrodes 29 by the dielectric post 34, as described in the referenced patent application Ser. No. 125,822.

The U-shaped support 36 is longitudinally dimensioned to extend beyond the entrance to the space 24 between the meshes 22 and 23 by the dimension L at which the cathode 26 is located with respect to the meshes 22 and 23. Accordingly, the dimension L is determined by electro-optic considerations in a manner known to those skilled in the electro-optics art. The cathode 26 is centered between the modulation electrodes 42*a* and 42*b*. The longitudinal position of the cathode 26 with respect to the longitudinal dimension of the electrodes 42*a* and 42*b* is not critical. The dimension I along which the U-shaped support 36 contacts the meshes 22 and 23 is selected to give the arms 41*a* and 41*b* the flexability needed to enable the tabs 38 to enter the apertures in the meshes 22 and 23.

The instant invention is advantageous because the line cathode 26 is self aligned during assembly and is supported uniformly and permanently with respect to the meshes 22 and 23. Preferably, the cathode is centered between the meshes to minimize long wavelength oscillations of the electron beam during propagation between the meshes 22 and 23, thereby substantially reducing electron beam wobble on the display screen when a visual output is produced. The accurate positioning of the cathode 26 with respect to the meshes 22 and 23 also is important because the cathode is uniformly spaced from and aligned to all of the guide meshes in all of the channels. The horizontal line segments which are produced across all the channels are thus horizontally aligned across the display screen. The supports can be made with high precision with existing technology so that the notches 37, and thus the cathode 26 are precisely positioned with respect to the space 24 between the meshes 22 and 23. The cathode is supported at the ends and tensioned against the notches 37 in a manner which forms no part of this invention.

In FIG. 2, the guide mesh assembly includes one U-shaped support 36 arranged substantially parallel to one edge of the meshes 22 and 23. Accordingly, if desired, one side of the meshes can be slightly widened to provide additional space for the apertures which receive the retaining tabs 38. Such widening would also displace the support 36 from the apertures 27 and decrease any affects of the support on the electron beams. The apertures which receive the tabs 38 can be very accurately located photolithographically on the meshes and acid etched in the same manner that the electron beam focusing apertures 27 are etched into the meshes. Each of the guide beam assemblies includes one U-shaped support 36 so that 40 supports would be used in a 40 channel flat panel display device. If desired, each of the arms 41*a* and 41*b* can be provided with two of the tabs 38, each of which engages an aperture in the meshes 22 and 23. Such an arrangement assures the longitudinal alignment of the U-shaped support 36 with the longitudinal axis of the meshes 22 and 23. Additionally, two of the supports 36 can be used with each beam guide assembly. This may be desirable if 32 channels, each 1.25" wide are used in the display device.

What is claimed is:

1. In a flat panel display device having an envelope including a baseplate, a front plate, sidewalls and a plurality of internal support walls dividing said envelope into a plurality of channels, each of said channels including a plurality of guide meshes arranged in a spaced parallel relationship to form a space between said meshes, said display device also having a line cathode arranged perpendicular to said channels for emitting electrons for propagation in said spaces, an improved cathode support structure for supporting said cathode equidistant from and in alignment with said spaces for all of said channels comprising:

a substantially U-shaped support including a closed end and two arms transversely dimensioned to span said space whereby said U-shaped support fits transversely across said space and said arms are spring biased against said meshes, said U-shaped support having high thermal conductivity and being electrically insulatively, said U-shaped support including an indention arranged in the closed end for supporting said cathode in alignment with said space and being longitudinally dimensioned to support said cathode a predetermined distance from said space;

said arms including retaining means for retaining said support between said guide meshes, and said guide meshes including additional retaining means arranged at a selected position from the input of said guide meshes for mating with said retaining means whereby said notch is positioned said predetermined distance from said space.

2. The cathode support of claim 1 whereby each of said channels includes one of said U-shaped supports arranged in the proximity of the edges of said meshes and extending substantially parallel to the longitudinal axis of said meshes.

3. The cathode support of claim 2 wherein said retaining means includes tabs arranged in the vicinity of the ends of the arms of said U-shaped support, and said additional retaining means includes apertures arranged in said meshes for receiving said tabs.

4. The cathode support of claim 3 wherein said U-shaped support has sufficient resiliency to spring load said arms against said meshes.

5. The cathode support of claim 3 wherein said meshes are resilient to spring load said meshes against said U-shaped support.

6. The cathode support of claim 4 or 5 wherein each of said U-shaped supports includes a plurality of said tabs and each of said meshes includes an equal plurality of said apertures to align said supports substantially parallel to the edges of said meshes.

7. The cathode support of claim 6 wherein said U-shaped supports are made from Quartz.

8. The cathode support of claims 2 or 4 wherein said U-shaped supports are made from Quartz.

* * * * *